US008474550B2

(12) United States Patent
Byreddy et al.

(10) Patent No.: US 8,474,550 B2
(45) Date of Patent: Jul. 2, 2013

(54) ADAPTIVE DRILLING CONTROL SYSTEM

(75) Inventors: Chakradhar R. Byreddy, Houston, TX (US); Dmtriy Dashevskiy, Nienhagen, DE (US); John D. Macpherson, Sugar Land, TX (US); Nimish Tambe, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/568,389

(22) Filed: Aug. 7, 2012

(65) Prior Publication Data

US 2013/0032402 A1 Feb. 7, 2013

Related U.S. Application Data

(63) Continuation of application No. 12/432,834, filed on Apr. 30, 2009, now Pat. No. 8,256,534.

(60) Provisional application No. 61/049,915, filed on May 2, 2008.

(51) Int. Cl.

| | |
|---|---|
| ***E21B 44/00*** | (2006.01) |
| ***E21B 45/00*** | (2006.01) |
| ***G06F 17/50*** | (2006.01) |
| ***G06G 7/50*** | (2006.01) |

(52) U.S. Cl.
USPC ..... 175/57; 175/27; 175/45

(58) Field of Classification Search
USPC ..... 175/27, 40, 57, 45, 24
See application file for complete search history.

(56) References Cited

U.S. PATENT DOCUMENTS

| | | | | |
|---|---|---|---|---|
| 4,120,198 | A * | 10/1978 | Tanguy et al. | 73/152.48 |
| 4,354,233 | A | 10/1982 | Zhukovsky et al. | |
| 4,793,421 | A | 12/1988 | Jasinski | |
| 5,141,364 | A * | 8/1992 | Degen et al. | 405/240 |
| 5,368,108 | A | 11/1994 | Aldred et al. | |
| 5,449,047 | A | 9/1995 | Schivley, Jr. | |
| 5,465,798 | A | 11/1995 | Edlund et al. | |
| 5,513,098 | A | 4/1996 | Spall et al. | |
| 6,026,912 | A | 2/2000 | King et al. | |
| 6,055,524 | A | 4/2000 | Cheng | |
| 6,155,357 | A | 12/2000 | King et al. | |
| 6,192,998 | B1 | 2/2001 | Pinckard | |
| 6,247,542 | B1 | 6/2001 | Kruspe et al. | |
| 6,293,356 | B1 | 9/2001 | King et al. | |
| 6,382,331 | B1 | 5/2002 | Pinckard | |
| 6,429,784 | B1 | 8/2002 | Beique et al. | |
| 6,516,898 | B1 | 2/2003 | Krueger | |

(Continued)

OTHER PUBLICATIONS

Abdulgalil, F and Siguerdidgane, H., "Nonlinear Control Design for Supressing Stick-Slip Oscillations in Oil Well Drillstrings," 2004, 5th Asian Control Conference, pp. 1276-1281.

(Continued)

*Primary Examiner* — Jennifer H Gay
(74) *Attorney, Agent, or Firm* — Cantor Colburn LLP

(57) ABSTRACT

A system for optimizing a rate-of-penetration of a drill string includes a plurality of sensors in operable communication with the drill string and a controller in operable communication with the plurality of sensors. The controller is connectable to a downhole active vibration control device and capable of outputting a signal to the downhole active vibration control device for optimizing the rate-of-penetration of the drill string.

27 Claims, 8 Drawing Sheets

U.S. PATENT DOCUMENTS

| | | | | |
|---|---|---|---|---|
| 6,564,883 | B2 | 5/2003 | Fredericks et al. | |
| 6,732,052 | B2 | 5/2004 | Macdonald et al. | |
| 6,839,000 | B2 | 1/2005 | Das et al. | |
| 7,044,239 | B2 | 5/2006 | Pinckard et al. | |
| 7,059,427 | B2 | 6/2006 | Power et al. | |
| 7,172,037 | B2 | 2/2007 | Dashevskiy et al. | |
| 7,172,038 | B2 | 2/2007 | Terry et al. | |
| 7,225,879 | B2 | 6/2007 | Wylie et al. | |
| 7,243,735 | B2 | 7/2007 | Koederitz et al. | |
| 7,556,105 | B2 | 7/2009 | Krueger | |
| 7,857,075 | B2 | 12/2010 | Jeffryes | |
| 7,921,937 | B2 | 4/2011 | Brackin et al. | |
| 7,938,197 | B2 | 5/2011 | Boone et al. | |
| 7,958,952 | B2 * | 6/2011 | Kusko et al. | 175/324 |
| 8,256,534 | B2 * | 9/2012 | Byreddy et al. | 175/57 |
| 2004/0195004 | A1 | 10/2004 | Power et al. | |
| 2004/0256152 | A1 | 12/2004 | Dashevskiy et al. | |
| 2005/0038352 | A1 | 2/2005 | Xue et al. | |
| 2005/0279532 | A1 | 12/2005 | Ballantyne et al. | |
| 2006/0162962 | A1 | 7/2006 | Koederitz et al. | |
| 2008/0156531 | A1 | 7/2008 | Boone et al. | |
| 2008/0164062 | A1 | 7/2008 | Brackin et al. | |
| 2009/0090555 | A1 | 4/2009 | Boone et al. | |
| 2009/0107723 | A1 * | 4/2009 | Kusko et al. | 175/25 |
| 2009/0250264 | A1 * | 10/2009 | Dupriest | 175/40 |
| 2009/0294174 | A1 | 12/2009 | Harmer et al. | |
| 2010/0108384 | A1 | 5/2010 | Byreddy et al. | |
| 2011/0291334 | A1 | 12/2011 | Wassell et al. | |

OTHER PUBLICATIONS

Abdulgalil, F. and Siguerdidjane, H., "Backstepping Design for Controlling Rotary Drilling Systerm," IEEE, Conference on Control Applications, Toronto, Canada, Aug. 28-31, 2005. pp. 120-124.

Fu, Y., Chai, T., and Wang, H., "Nonlinear Indirect Adaptive Decoupling Control Based on Neural Networks and Multiple Models," Proceedings of the 2006 American Control Conference, Minneapolis, Minnesota, USA, Jun. 14-16, 2006. pp. 3692-3697.

Phuah J., and Yahagi, T., "Model Reference Adaptive Control for Multi-Input Multi-Output Nonlinear Systems using Neural Networks," IEEE, 2001. pp. 303-308.

Notification Concerning Transmittal of International Preliminary Report on Patentability and Written Opinion of the International Searching Authority for International Application No. PCT/US2009/042577. Mailed Nov. 11, 2010.

* cited by examiner

ADAPTIVE DRILLING CONTROL SYSTEM

CROSS REFERENCE TO RELATED APPLICATION

This application is a continuation application of U.S. Ser. No. 12/432,834, filed Apr. 30, 2009 which is a non-provisional application of U.S. Ser. No. 61/049,915, filed May 2, 2008, the contents of which are incorporated by reference herein in their entirety.

BACKGROUND OF THE INVENTION

1. Field of the Invention

The invention disclosed herein relates to drilling a borehole into the earth and, in particular, to controlling the drilling in an optimal manner.

2. Description of the Related Art

Exploration and production of hydrocarbons generally requires that a borehole be drilled deep into the earth. The borehole provides access to a geologic formation that may contain a reservoir of oil or gas.

Drilling operations require many resources such as a drilling rig, a drilling crew, and support services. These resources can be very expensive. In addition, the expense can be even much higher if the drilling operations are conducted offshore. Thus, there is an incentive to contain expenses by drilling the borehole efficiently.

Efficiency can be measured in different ways. In one way, efficiency is measured by how fast the borehole can be drilled. Drilling the borehole too fast, though, can lead to problems. If drilling the borehole at a high rate-of-penetration results in a high probability damaging equipment, then resources may be wasted in downtime and repairs. In addition, attempts at drilling the borehole too fast can lead to abnormal drilling events that can slow the drilling process.

Therefore, what are needed are techniques to optimize a rate-of-penetration while drilling a borehole. Preferably, the techniques automatically optimize the rate-of-penetration.

BRIEF SUMMARY OF THE INVENTION

Disclosed is a system for optimizing a rate-of-penetration of a drill string. The system includes a plurality of sensors in operable communication with the drill string and a controller in operable communication with the plurality of sensors. The controller is connectable to a downhole active vibration control device and capable of outputting a signal to the downhole active vibration control device for optimizing the rate-of-penetration of the drill string.

Also disclosed is a method for optimizing a rate-of-penetration of a drill string in a borehole. The method includes receiving a measurement from at least one sensor in a plurality of sensors in operative communication with the drill string and transmitting a signal from a controller to a downhole active vibration control device for optimizing the rate-of-penetration of the drill string.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
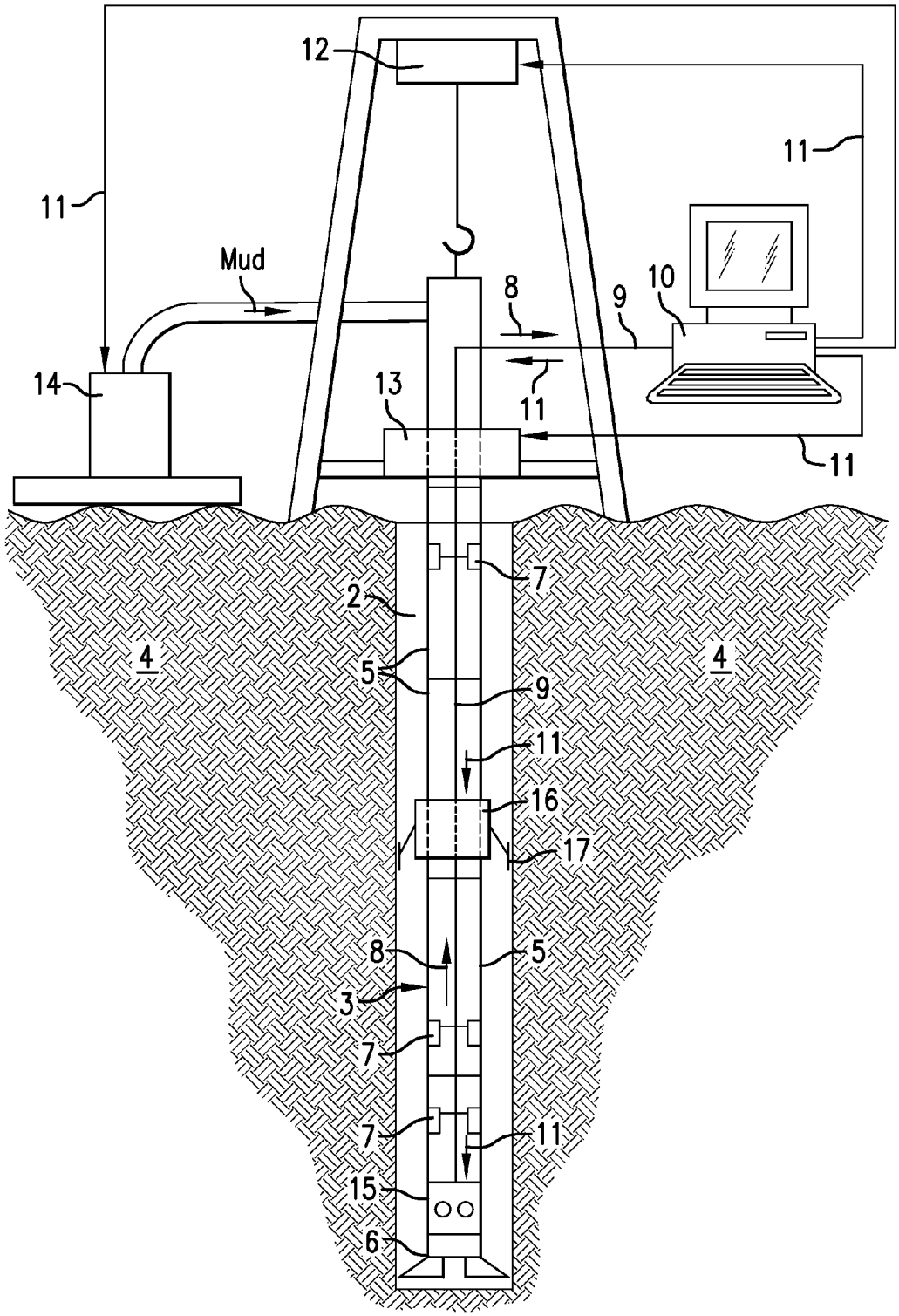
FIG. 1 illustrates an exemplary embodiment of a drill string disposed in a borehole penetrating the earth.

Disclosed are techniques for optimizing a rate-of-penetration while drilling a borehole. The techniques provide for automatically optimizing the rate-of-penetration by using data from sensors monitoring a drill string and controlling at least one input to the drill string based on the data.

The techniques, which include apparatus and methods, use sensors in operable communication with the drill string used for drilling the borehole. The sensors provide data related to the drill string such as vibration or rotational speed at various parts of the drill string. Other sensors may be used to monitor performance of a machine (or drill string motivator) inputting energy or applying a force to the drill string such as a rotary device for turning the drill string.

In addition to the sensors, the techniques use a controller to receive the data from the sensors and for providing a control signal to the drill string motivator to optimize the rate-of-penetration. An optimal rate-of-penetration is generally a function of several variables. Non-limiting examples of these variables include drill bit rotary speed, vertical force applied to the drill bit (weight on bit), the type of drill bit, alignment of the drill bit in the borehole, and the lithology of the formation being drilled. Thus, by optimizing the variables that can be controlled, the rate-of-penetration can also be optimized. For example, one way that the rate-of-penetration can be optimized is to provide the highest weight on bit that still allows the drill bit to rotate above a minimum constant speed (i.e., minimizing speed oscillations). Additionally, the rate-of-penetration can be monitored by measuring the movement of the drill string into the borehole. In one embodiment, the rate-of-penetration can be used as a feedback control signal to the controller. The controller can be located at least one of remote to and at the drill string. In addition, control can be distributed at several locations.

Vibration of the drill string can impede attaining the optimal rate-of-penetration. Accordingly, the techniques include limiting an amount of vibration experienced by the drill string. Vibration can be controlled by adjusting or setting the output of at least one drill string motivator. In addition, the controller can control at least one active vibration control device disposed at the drill string in the borehole.

The techniques also provide for detecting an abnormal drilling event and for inputting an appropriate control signal to the drill string motivator to terminate the abnormal drilling event.

For convenience, certain definitions are provided. The term "rate-of-penetration" relates to a distance drilled into the earth divided by a period of time for which the distance was achieved. The term "drill string" relates to at least one of drill pipe and a bottom hole assembly. In general, the drill string includes a combination of the drill pipe and the bottom hole assembly. The bottom hole assembly may be a drill bit, sampling apparatus, logging apparatus, or other apparatus for performing other functions downhole. As one example, the bottom hole assembly can include a drill bit and a drill collar containing measurement while drilling (MWD) apparatus.

The term "vibration" relates to oscillations or vibratory motion of the drill string. A vibration of a drill string can include at least one of axial vibration such as bounce, lateral vibration, and torsional vibration. Torsional vibration can result in the drill bit rotating at oscillating speeds when the drill string at the surface is rotating at a constant speed. Vibration can include vibrations at a resonant frequency of the drill string. Vibration can occur at one or more frequencies and at one or more locations on the drill string. For instance, at one location on the drill string, a vibration at one frequency can occur and at another location, another vibration at another frequency can occur. The term "limit the vibration" relates to providing an input to an apparatus or a system in operable communication with the drill string to at least one of decrease an amplitude of the vibration or change the frequency of the vibration.

The term "sensor" relates to a device for measuring at least one parameter associated with the drill string. Non-limiting examples of types of measurements performed by a sensor include acceleration, velocity, distance, angle, force, moment, temperature, pressure, and vibration. As these sensors are known in the art, they are not discussed in any detail herein.

The term "controller" relates to a control device with at least a single input and at least a single output. Non-limiting examples of the type of control performed by the controller include proportional control, integral control, differential control, model reference adaptive control, model free adaptive control, observer based control, and state space control. One example of an observer based controller is a controller using an observer algorithm to estimate internal states of the drill string using input and output measurements that do not measure the internal state. In some instances, the controller can learn from the measurements obtained from the distributed control system to optimize a control strategy. The term "observable" relates to performing one or more measurements of parameters associated with the motion of the drill string wherein the measurements enable a mathematical model or an algorithm to estimate other parameters of the drill string that are not measured. The term "state" relates to a set of parameters used to describe the drill string at some moment in time.

The term "model reference adaptive control" relates to use of a model of a process to determine a control signal. The model is generally a system of equations that mathematically describe the process. The term "model free adaptive control" relates to controlling a system where equations governing the system are unknown and where a controller is estimated without assuming a model for the system. In general, the controller is constructed using a function approximator such as a neural network or polynomial.

The term "drill string motivator" relates to an apparatus or system that is used to operate the drill string. Non-limiting examples of a drill string motivator include a "lift system" for supporting the drill string, a "rotary device" for rotating the drill string, a "mud pump" for pumping drilling mud through the drill string, an "active vibration control device" for limiting vibration of the drill string, and a "flow diverter device" for diverting a flow of mud internal to the drill string. The term "weight on bit" relates to the force imposed on the bottom hole assembly such as a drill bit. Weight on bit includes a force imposed by the lift system and an amount of force caused by the flow mud impacting on the bottom hole assembly. The flow diverter and mud pump, therefore, can affect weight on bit by controlling the amount of mud impacting the bottom hole assembly. The term "optimizing a rate-of-penetration" relates to providing a control signal from a controller to a drill string motivator to obtain substantially the highest rate-of-penetration. Generally, an optimized rate-of-penetration is commensurate with preventing damage to drilling equipment.

The term "broadband communication system" relates to a system for communicating in real time. The term "real time" relates to transmitting a signal downhole with little time delay. The broadband communication system generally uses electrical conductors or a fiber optic as a transmission medium. As used herein, transmission of signals in "real-time" is taken to mean transmission of the signals at a speed that is useful or adequate for optimizing the rate-of-penetration. Accordingly, it should be recognized that "real-time" is to be taken in context, and does not necessarily indicate the instantaneous transmission of measurements or instantaneous transmission of control signals.

The term "couple" relates to at least one of a direct connection and an indirect connection between two devices. The term "decoupling" relates to accounting for process interactions (static and dynamic) in a controller.

FIG. 1 illustrates an exemplary embodiment of a drill string 3 disposed in a borehole 2 penetrating the earth 4. The borehole 2 can penetrate a geologic formation that includes a reservoir of oil or gas. The drill string 3 includes drill pipe 5 and a bottom hole assembly 6. The bottom hole assembly 6 can include a drill bit or drilling device for drilling the borehole 2. In the embodiment of FIG. 1, a plurality of sensors 7 is disposed along a length the drill string 3. The plurality of sensors 7 measures aspects related to operation of the drill string 3, such as motion of the drill string 3. A broadband communication system 9 transmits data 8 from the sensors 7 to a controller 10. The data 8 includes measurements performed by the sensors 7. The controller 10 is configured to provide a control signal 11 to a drill string motivator. The broadband communication system 9 can include a fiber optic or "wired pipe" for transmitting the data 8 and the control signal 11.

In one embodiment of wired pipe, the drill pipe 5 is modified to include a broadband cable protected by a reinforced steel casing. At the end of each drill pipe 5, there is an inductive coil, which contributes to communication between two drill pipes 5. In this embodiment, the broadband cable is used to transmit the data 8 and the control signal 11. About every 500 meters, a signal amplifier is disposed in operable communication with the broadband cable to amplify the communication signal to account for signal loss.

One example of wired pipe is INTELLIPIPE® commercially available from Intellipipe of Provo, Utah, a division of Grant Prideco. One example of the broadband communication system 9 using wired pipe is the INTELLISERV® NETWORK also available from Grant Prideco. The Intelliserv Network has data transfer rates from fifty-seven thousand bits per second to one million bits per second or more. The broadband communication system 9 enables sampling rates of the sensors 7 at up to 200 Hz or higher with each sample being transmitted to the controller 10 at a location remote from the sensors 7.

Various drill string motivators may be used to operate the drill string 3. The drill string motivators depicted in FIG. 1 are a lift system 12, a rotary device 13, a mud pump 14, a flow diverter 15, and an active vibration control device 16. Each of the drill string motivators depicted in FIG. 1 are coupled to the controller 10. The controller 10 can provide the control signal 11 to each of these drill string motivators to control at least one aspect of their operation. For example, the control signal 11 can cause the lift system 12 to impart a certain force on the drill string 3. The controller 10 can also control: the rotary device 13 to at least one of control the rotational speed of the drill string 3 and control the torque imposed on the drill string 3; the flow of mud from the mud pump 14; the amount of mud diverted by the flow diverter 15; and operation of the active vibration control device 16.

Referring to FIG. 1, the active vibration control device 16 includes vibration control elements 17. In one embodiment, at least one element 17 can be extended from the device 16 upon receipt of the control signal 11 to absorb or control vibration. The active vibration control device 16 may include vibration absorbing apparatus such as hydraulic shock absorbers and vibration damping materials that can compress or stretch to dampen vibrations. In another embodiment, the active vibration control device 16 can include a hydraulic thruster. The control signal 11 can be configured to provide an amount of force to be applied by the active vibration control device 16 or an amount of vibration to be dampened by the active vibration control device 16.

Figure 2:
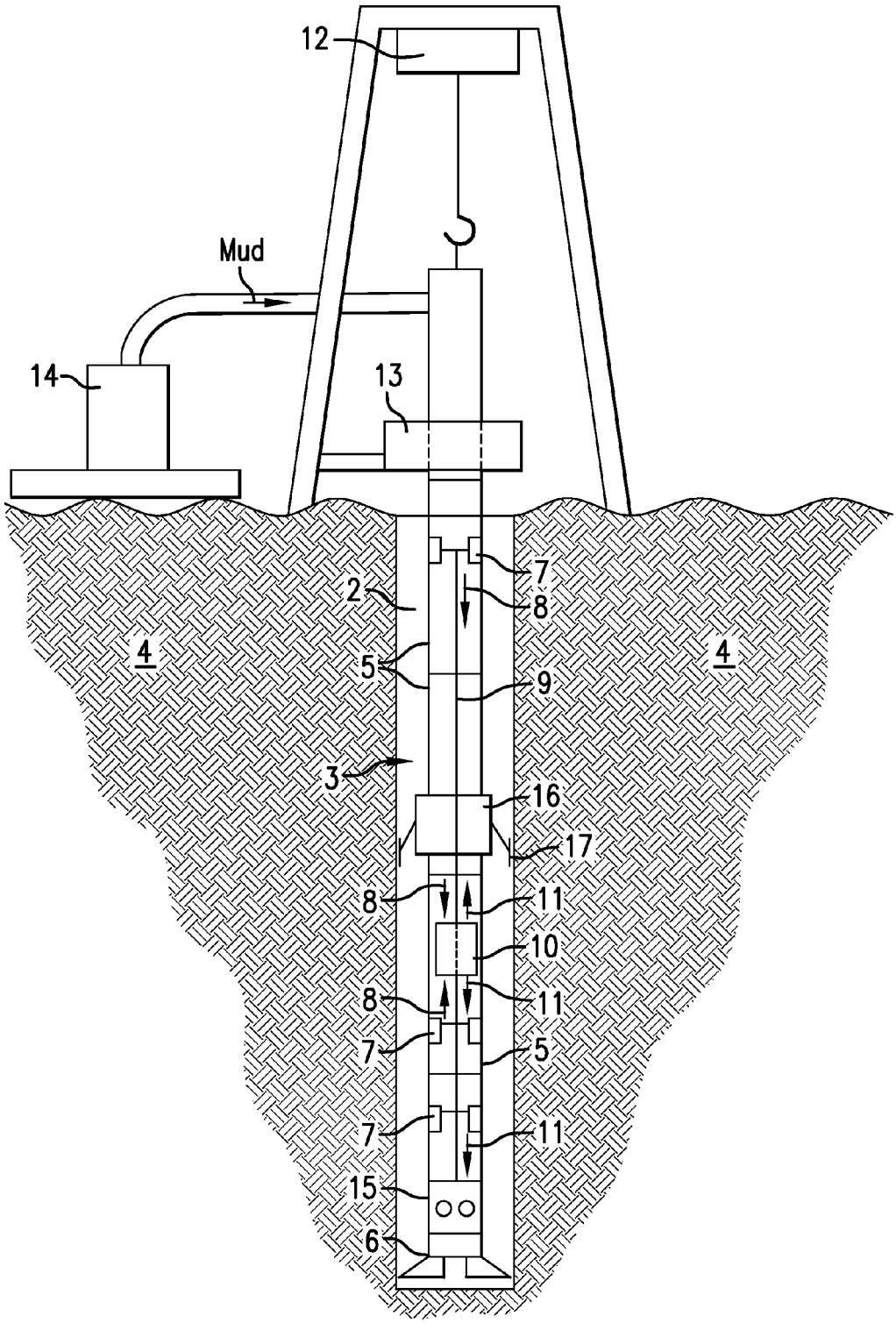
FIG. 2 illustrates an exemplary embodiment of the drill string that includes a controller.

FIG. 2 illustrates another exemplary embodiment of the techniques for optimizing the rate-of-penetration of the drill string 3 into the earth 4. In the embodiment of FIG. 2, the controller 10 is disposed at the drill string 3 in the borehole 2. The controller 10 depicted in FIG. 2 controls the flow diverter 15 to control the weight on bit and the active vibration control device 16 to limit an amount of vibration experienced by the bottom hole assembly 6.

Figure 3:
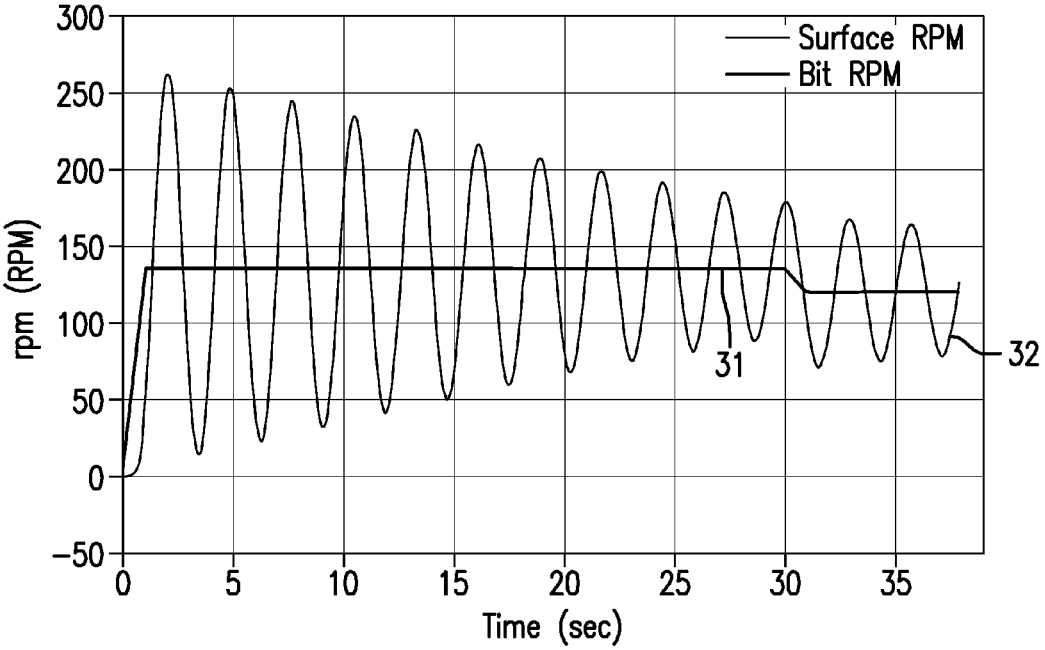
FIG. 3 depicts an example of rotary speed distortion experienced by a bottom hole assembly disposed at the drill string.

The rate-of-penetration of the drill string 3 into the earth 4 can be affected by the amount of vibration experienced by the bottom hole assembly 6. One example of the vibration is torsional vibration. Torsional vibration relates to the difference in rotational speed or direction between the drill string 3 at the surface of the earth 4 and the bottom hole assembly 6 at the other end of the drill string 3. FIG. 3 depicts an example of torsional vibration experienced by the bottom hole assembly 6. FIG. 3 illustrates a graph 31 of a surface speed of the drill string 3 and a graph 32 of bit speed of the bottom hole assembly 6. Referring to FIG. 3, oscillations of the bit speed with respect to the surface speed can be observed as the torsional vibration. These oscillations can degrade the rate-of-penetration. In general, these oscillations may be caused by the dynamics of the drill string 3 resulting from forces acting on the drill string 3. Because the drill string motivators can apply a force to the drill string 3, the drill string motivators can be used to counteract vibration detected by the sensors 7.

Other types of abnormal events can also affect the drill string 3. Examples of other abnormal events include "stick-slip" and "whirl." Stick-slip relates to binding and release of the drill string 3. Whirl relates to the condition where the bottom hole assembly 6 rotates in a direction opposite the direction of rotation of the drill string 3 at the rotary device 13. Whirl can result in the bottom hole assembly 6 uncoupling from a drill pipe 5. The techniques presented herein call for the controller 10 detecting an abnormal event and providing the control signal 11 to at least one drill string motivator to counteract the event. For example, if whirl is detected by the sensors 7, then the control signal 11 can be used to stop rotation of the drill string 3 by the rotary device 13 and lift the bottom hole assembly 6 off the bottom of the borehole 2 using the lift system 12. The controller 10 can then restart drilling when the whirl (or abnormal event) has ceased.

Turning now to the controller 10, the controller 10 may include a computer processing system. Exemplary components of the computer processing system include, without limitation, at least one processor, storage, memory, input devices, output devices and the like. As these components are known to those skilled in the art, these are not depicted in any detail herein.

Generally, some of the teachings herein are reduced to an algorithm that is stored on machine-readable media. The algorithm is implemented by the computer processing system and provides operators or users with desired output. One example of the output is at least one of displaying and recording a rate of penetration of the drill string 3.

Figure 4A:
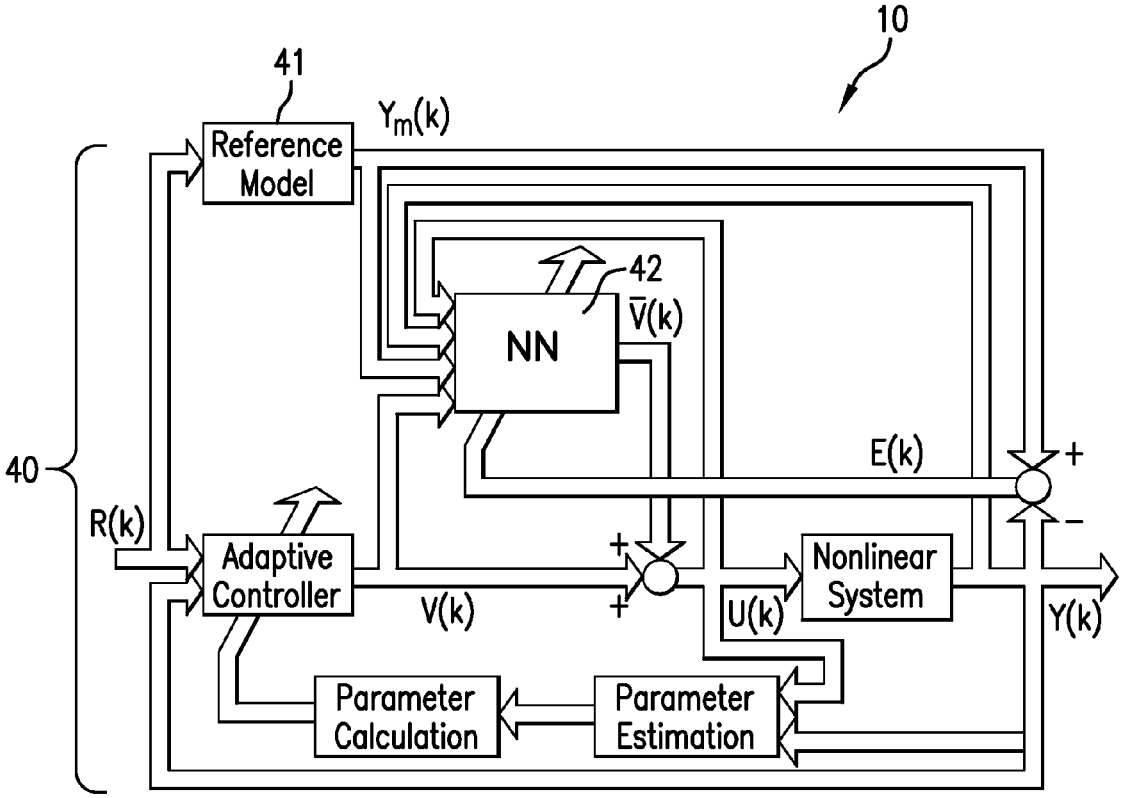
FIGS. 4A, 4B, and 4C, collectively referred to as FIG. 4, depict aspects of the controller using model reference adaptive control.
Figure 4B:
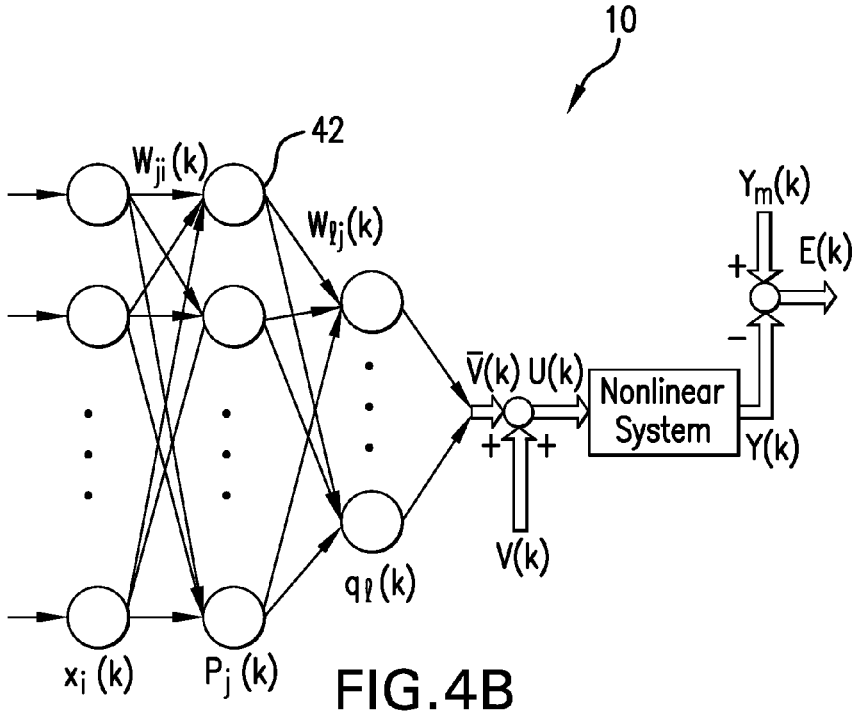
Figure 4C:
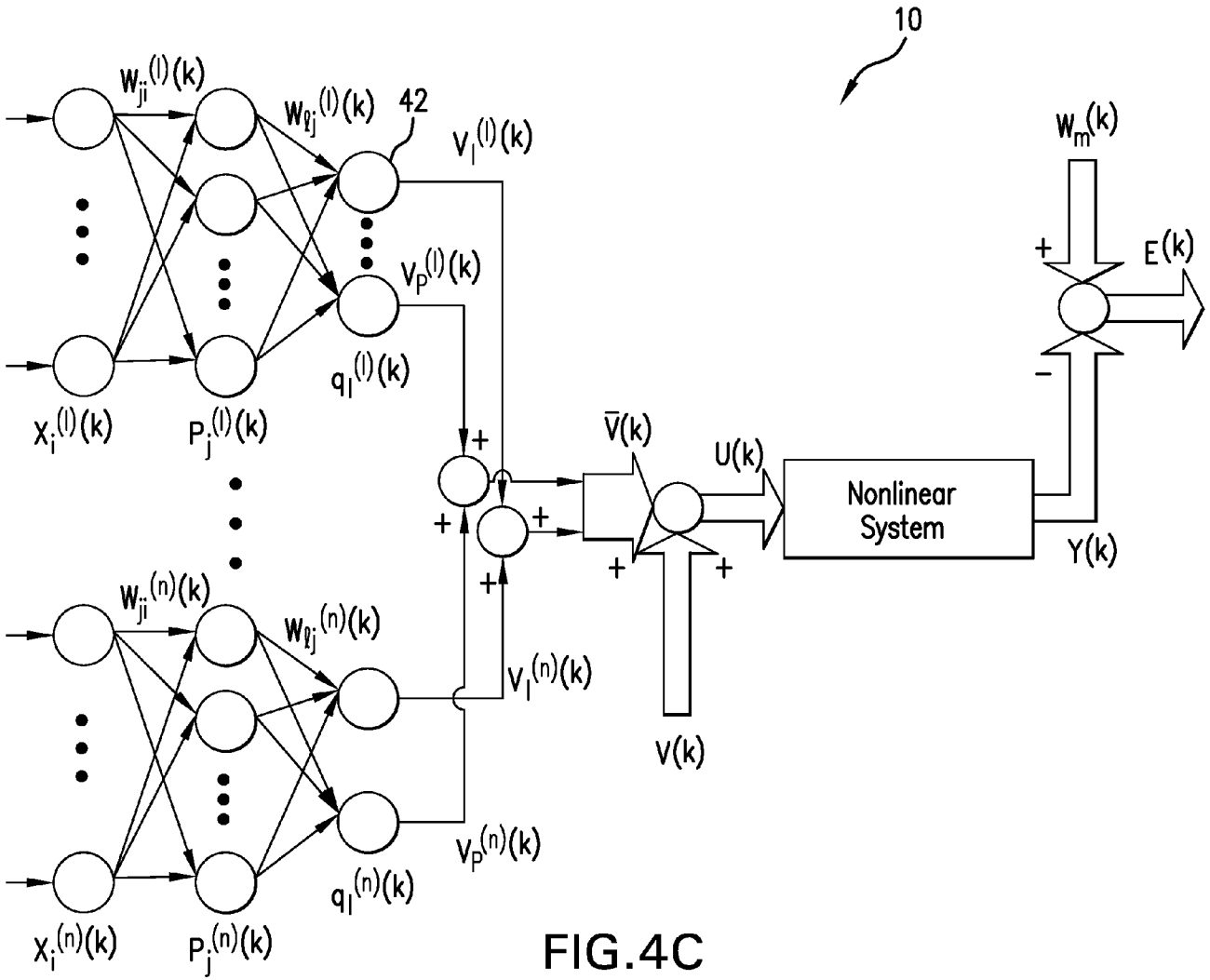

In general, an increased number of sensors 7 and an increased number of drill string motivators result in an increased rate-of-penetration. Thus, in a preferred embodiment, the controller 10 has multiple inputs and multiple outputs (MIMO). Examples of control methods for a MIMO controller 10 include model reference adaptive control and model free adaptive control. FIG. 4 depicts aspects of the controller 10 using model reference adaptive (MRA) control. FIG. 4A illustrates a block diagram of an MRA control system 40 that includes a model reference 41 and a neural network 42. FIG. 4B depicts aspects of the neural network 42. FIG. 4C depicts more detailed aspects of the neural network 42. The block type arrows shown in FIG. 4 indicate that the variables are vectors. The reference model 41 includes equations that model the drill string 3. The neural network 42 is used to compensate for any non-linearity of dynamics of the drill string 3 not taken into account in the reference model 41. The role of the neural network 42 is to construct a linearized model by minimizing error caused by non-linearities in the controller 10, the sensors 7, and the drill string motivators.

Figure 5A:
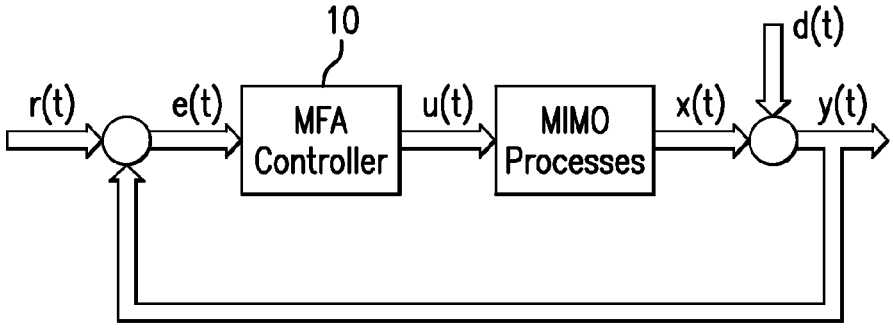
FIGS. 5A, 5B, and 5C, collectively referred to as FIG. 5, depict aspects of the controller using model free adaptive (MFA) control.
Figure 5B:
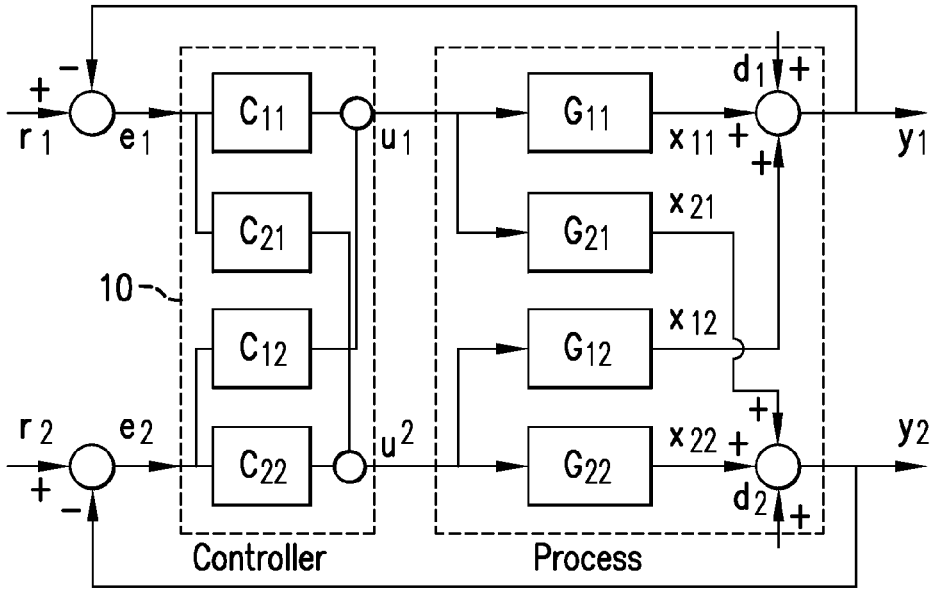

The model free adaptive (MFA) control method is used when the equations for modeling the drill string 3 are unknown. FIG. 5 depicts aspects of the controller 10 using MFA control (referred to as MFA controller 10). FIG. 5A illustrates a block diagram of MFA control. The block type arrows in FIG. 5 indicate that the variables are vectors. FIG. 5B depicts aspects of the MFA controller 10 using compensators $C_{21}$ and $C_{12}$ for decoupling process interactions, designated as $G_{21}$ and $G_{12}$. Thus, by the nature of the 2×2 process depicted in FIG. 5B, the inputs $u_1$ and $u_2$ to the 2×2 process are interconnected with outputs $y_1$ and $y_2$. The change in one input, therefore, can cause both outputs to change.

Figure 5C:
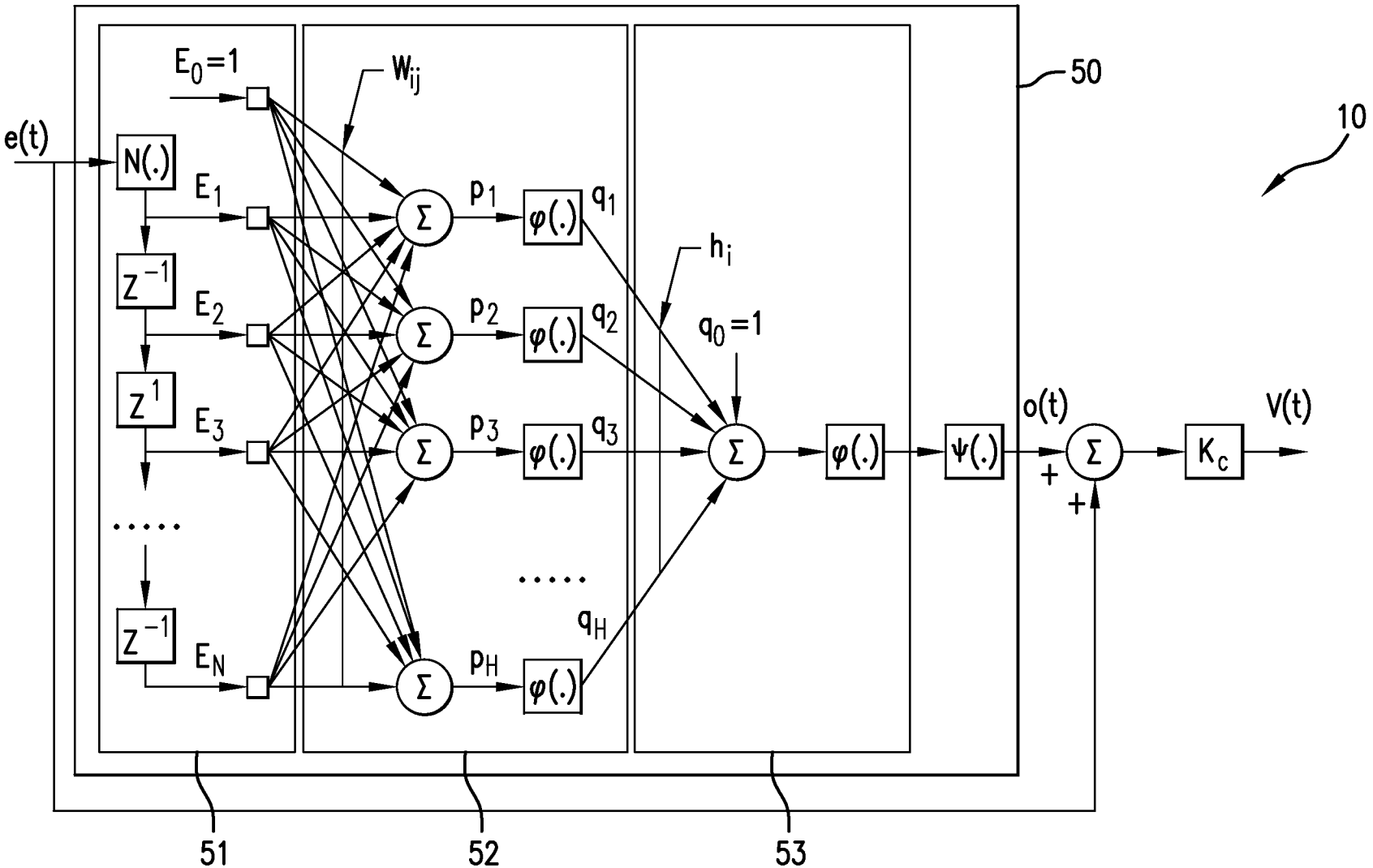

FIG. 5C depicts aspects of core architecture for the MFA controller 10 that has a single input and a single output (SISO). SISO control is presented for discussion purposes. The MFA controller 10 depicted in FIG. 5C has a multilayer perceptron neural network 50 that includes an input layer 51, a hidden layer 52 with N neurons, and an output layer 53 with one neuron. Within the neural network 50, there are groups of weighting factors ($w_{ij}$ and $h_i$) that can be updated as needed to vary the behavior of the MFA controller 10. An algorithm for updating the weighting factors is based on a goal of minimizing error (e(t)) between a set point and a process variable. Since the goal is the same as the control objective, the adaptation of the weighting factors can assist the MFA controller 10 while process dynamics are changing. In addition, the MFA controller 10 including the neural network 50 stores at least a portion of process data, thereby, providing information for the process dynamics.

Figure 6:
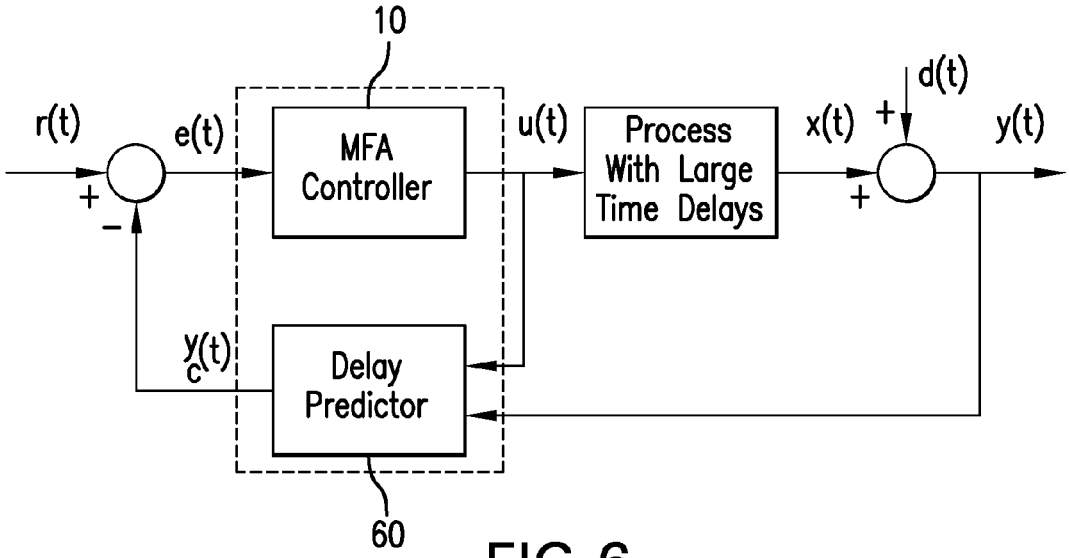
FIG. 6 depicts aspects of a delay predictor for use with a MFA controller.

FIG. 6 depicts aspects of a delay predictor 60 for use with the MFA controller 10 when the process exhibits large time delays. The delay predictor 60 produces a dynamic signal $y_c(t)$ as the feedback signal to the MFA controller 10. The goal of the delay predictor 60 is to produce the error signal e(t) for the MFA controller 10 so that the MFA controller 10 can experience an effect of its control action without much delay. In other words, the dynamic signal $y_c(t)$ is an artificial feedback signal that is able to keep the feedback loop working even when the process exhibits large time delays. Since the MFA controller 10 adapts, the delay predictor 60 can be of simple form. Compared to a Smith Predictor, the delay predictor 60 does not require a precise model. The delay predictor 60 uses an estimated time delay. If the estimated time delay has a mismatch with the actual process time delay, then the MFA controller 10 is adaptive enough to adjust to the difference. Generally, satisfactory performance is achieved in a situation where the time delay is two to five times larger or smaller than the actual time delay. In addition, the delay predictor 60 can be used with generally any size process Tau/T ratio (where Tau=time delay and t=time constant).

Model free adaptive control software and delay predictor software are commercially available from CyboSoft, General Cybernation Group, Inc., of Rancho Cordova, Calif. This software may be ported to computer processing systems and commercially available controllers.

Figure 7:
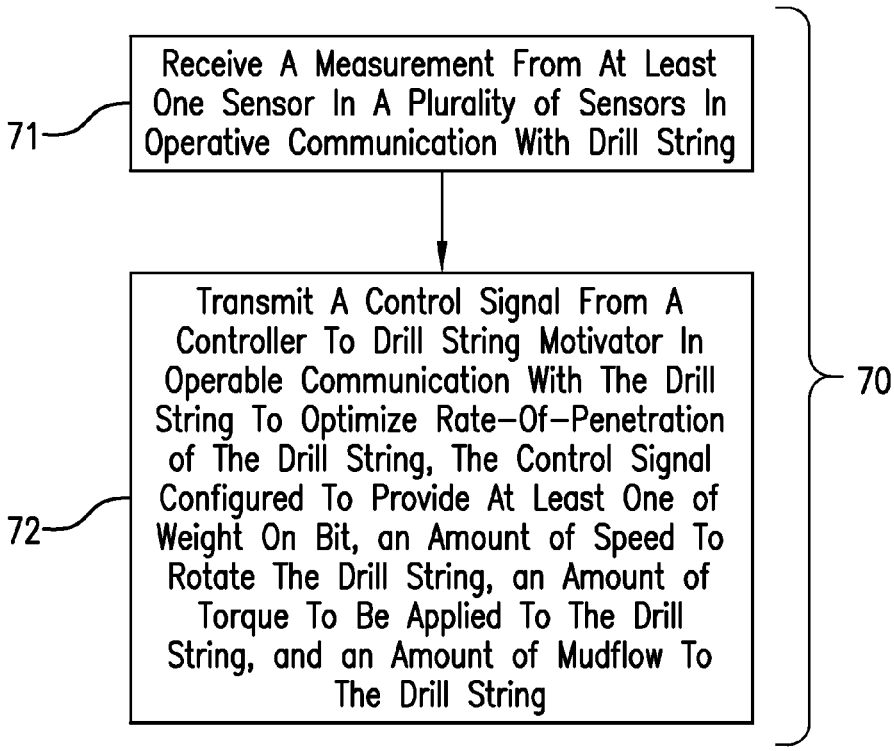
FIG. 7 presents an example of a method for optimizing a rate-of-penetration of the drill string.

FIG. 7 presents an example of a method 70 for optimizing a rate-of-penetration of the drill string 3. The method 70 calls for (step 71) receiving a measurement from at least one sensor 7 in operative communication with the drill string 3. Further, the method 70 calls for (step 72) transmitting the control signal 11 from the controller 10 to a drill string motivator for optimizing the rate-of-penetration of the drill string 3, wherein the control signal 11 is configured to provide at least one of weight on bit, an amount of speed to rotate the drill string, an amount of torque to be applied to the drill string, and an amount of mudflow to the drill string.

In support of the teachings herein, various analysis components may be used, including digital and/or an analog systems. For example, the controller 10 can include digital or analog systems. The system may have components such as a processor, storage media, memory, input, output, communications link (wired, wireless, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, operator, owner, user or other such personnel, in addition to the functions described in this disclosure.

Further, various other components may be included and called upon for providing for aspects of the teachings herein. For example, a power supply (e.g., at least one of a generator, a remote supply and a battery), vacuum supply, pressure supply, cooling component, heating component, motive force (such as a translational force, propulsional force or a rotational force), magnet, electromagnet, sensor, electrode, transmitter, receiver, transceiver, antenna, controller, optical unit, mechanical unit (such as a shock absorber, vibration absorber, or hydraulic thruster), electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for optimizing a rate-of-penetration of a drill string, the system comprising:

a plurality of sensors in operable communication with the drill string; and a controller in operable communication with the plurality of sensors, the controller connectable to a downhole active vibration control device and capable of outputting a signal to the downhole active vibration control device for optimizing the rate-of-penetration of the drill string, wherein the signal is configured to limit vibration of the drill string and the vibration comprises torsional vibration.

2. The system as in claim 1, wherein the signal is further configured to provide an amount of vibration to be dampened.

3. The system as in claim 1, wherein the downhole active vibration control device comprises a vibration control element configured to extend from the active vibration control device in order to absorb or control vibration.

4. The system as in claim 3, wherein the vibration control element is configured to extend from the downhole active vibration control device upon receipt of the signal.

5. The system as in claim 1, wherein the active vibration control device is configured to divert a fluid flowing in the drill string.

6. The system as in claim 5, wherein the controller is configured to control an amount of diverted fluid.

7. The system as in claim 1, wherein the sensors are sensitive to at least one of force, moment, acceleration, stress, strain, velocity, distance, angle, pressure, temperature, or vibration.

8. The system as in claim 1, wherein a set of sensors within the plurality of sensors is disposed along the drill string.

9. The system as in claim 1, wherein at least one sensor in the plurality is sensitive to a rate of travel of the drill string.

10. The system as in claim 1, wherein the controller comprises a plurality of inputs and a plurality of outputs.

11. The system as in claim 10, wherein the controller comprises a neural network.

12. The system as in claim 11, wherein the controller comprises model reference adaptive control.

13. The system as in claim 11, wherein the controller comprises model free adaptive control.

14. The system as in claim 11, further comprising a delay predictor configured to produce a dynamic signal that is an artificial feedback signal in a feedback loop.

15. The system as in claim 1, further comprising a broadband communication system configured to couple the plurality of sensors to the controller and the controller to the downhole active vibration control device, the controller being disposed at a surface of the earth.

16. The system as in claim 1, wherein the controller is disposed downhole at the drill string.

17. A method for optimizing a rate-of-penetration of a drill string in a borehole, the method comprising:

receiving a measurement from at least one sensor in a plurality of sensors in operative communication with the drill string; and transmitting a signal from a controller to a downhole active vibration control device for optimizing the rate-of-penetration of the drill string, the signal being configured to limit vibration of the drill string and the vibration comprising torsional vibration.

18. The method as in claim 17, wherein the signal is further configured to limit vibration of the drill string.

19. The method as in claim 17, further comprising extending a vibration control element from the downhole active vibration control device upon receipt of the signal in order to absorb or control vibration.

20. The method as in claim 17, further comprising identifying an adverse drilling event.

21. The method as in claim 20, further comprising stopping drilling in response to identifying the adverse drilling event.

22. The method as in claim 21, further comprising restarting drilling after the abnormal event is terminated.

23. The method as in claim 17, wherein the controller comprises a neural network.

24. The method as in claim 23, wherein the controller further comprises model reference adaptive control.

25. The method as in claim 23, wherein the controller further comprises model free adaptive control.

26. The method as in claim 17, further comprising producing a dynamic signal, at a delay predictor, that is an artificial feedback signal in a feedback loop.

27. A system for optimizing a rate-of-penetration of a drill string, the system comprising:

a plurality of sensors in operable communication with the drill string; and a controller in operable communication with the plurality of sensors, the controller connectable to a downhole active vibration control device and capable of outputting a signal to the downhole active vibration control device for optimizing the rate-of-penetration of the drill string, wherein the downhole active vibration control device comprises a vibration control element configured to extend from the active vibration control device to a borehole wall in order to absorb or control vibration.

* * * * *